US011660523B2

(12) United States Patent
Merlo

(10) Patent No.: US 11,660,523 B2
(45) Date of Patent: May 30, 2023

(54) BLADE GUARD

(71) Applicant: VIS-VERSA' S.R.L., Treviso (IT)

(72) Inventor: Sabrina Merlo, Treviso (IT)

(73) Assignee: VIS-VERSA' S.R.L., Treviso (IT)

( * ) Notice: Subject to any disclaimer, the term of this patent is extended or adjusted under 35 U.S.C. 154(b) by 0 days.

(21) Appl. No.: 17/423,922

(22) PCT Filed: Jan. 22, 2020

(86) PCT No.: PCT/IB2020/050468
§ 371 (c)(1),
(2) Date: Jul. 19, 2021

(87) PCT Pub. No.: WO2020/152588
PCT Pub. Date: Jul. 30, 2020

(65) Prior Publication Data

US 2022/0088465 A1 Mar. 24, 2022

(30) Foreign Application Priority Data

Jan. 25, 2019 (IT) ..... 102019000001179

(51) Int. Cl.
*A63C 3/12* (2006.01)

(52) U.S. Cl.
CPC ..... *A63C 3/12* (2013.01)

(58) Field of Classification Search
CPC ..... A63C 3/12; A63C 17/18
See application file for complete search history.

(56) References Cited

U.S. PATENT DOCUMENTS 2,213,966 A * 9/1940 Nygaard ..... A63C 3/12 280/11.18
2,218,803 A * 10/1940 Harrison ..... A63C 3/12 24/697.2
2,238,084 A * 4/1941 Tuell ..... A63C 3/12 280/825
4,264,090 A * 4/1981 Davies ..... A63C 3/12 280/825
4,365,828 A * 12/1982 Hall ..... A63C 3/12 280/825
4,382,615 A * 5/1983 Gronborg ..... A63C 3/12 280/825
4,382,616 A * 5/1983 Olivieri ..... A63C 3/12 280/825

(Continued)

FOREIGN PATENT DOCUMENTS

DE 579716 C 6/1933
WO WO-2020152588 A1 * 7/2020 ..... A63C 3/12

OTHER PUBLICATIONS

Internaitional Search Report of PCT/IB2020/050468 dated May 4, 2020.

*Primary Examiner* — Jeffrey J Restifo
(74) *Attorney, Agent, or Firm* — Mark M. Friedman

(57) ABSTRACT

A blade guard is described for protecting the edges of an ice-skate blade. To manage more than one blade size, the blade guard consists of or comprises a monolithic element elongated along a longitudinal axis (X) and provided with a longitudinal groove for receiving the edges, wherein the groove is formed in a bellows-like-like structure that is deformable along the axis (X) to vary the overall length of the element and of the groove.

20 Claims, 3 Drawing Sheets

(56) References Cited

U.S. PATENT DOCUMENTS

| | | | | | |
|---|---|---|---|---|---|
| 4,392,674 | A * | 7/1983 | Evon | A63C 3/12 | 280/825 |
| 4,673,196 | A * | 6/1987 | Hall | A63C 3/12 | 280/825 |
| 5,513,881 | A * | 5/1996 | DiMeglio | A63C 3/12 | 280/825 |
| 5,573,275 | A * | 11/1996 | Smith | A63C 17/20 | 280/825 |
| 5,769,434 | A * | 6/1998 | Wurthner | A63C 1/30 | 280/11.18 |
| 6,312,017 | B1 * | 11/2001 | Hardwick | A63C 3/10 | 451/558 |
| D574,458 | S * | 8/2008 | Mayer | D21/772 | |
| 10,195,515 | B2 * | 2/2019 | Mayer | A63C 1/303 | |
| 2008/0150242 | A1 * | 6/2008 | Wurthner | A63C 1/32 | 280/11.18 |
| 2008/0231007 | A1 * | 9/2008 | Mayer | A63C 17/18 | 280/825 |
| 2011/0079995 | A1 * | 4/2011 | Hirano | A63C 3/12 | 280/825 |
| 2011/0221180 | A1 * | 9/2011 | Kimball | A43B 5/185 | 280/825 |
| 2012/0001396 | A1 * | 1/2012 | Marcello | A63C 3/12 | 280/7.13 |
| 2012/0013112 | A1 * | 1/2012 | Kapp | A63C 3/12 | 280/825 |
| 2014/0319790 | A1 * | 10/2014 | Mayer | A63C 1/303 | 280/11.18 |
| 2015/0321071 | A1 * | 11/2015 | Schoenike | A63C 3/12 | 280/825 |

* cited by examiner

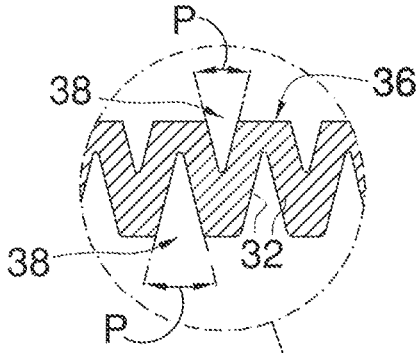
Fig. 4
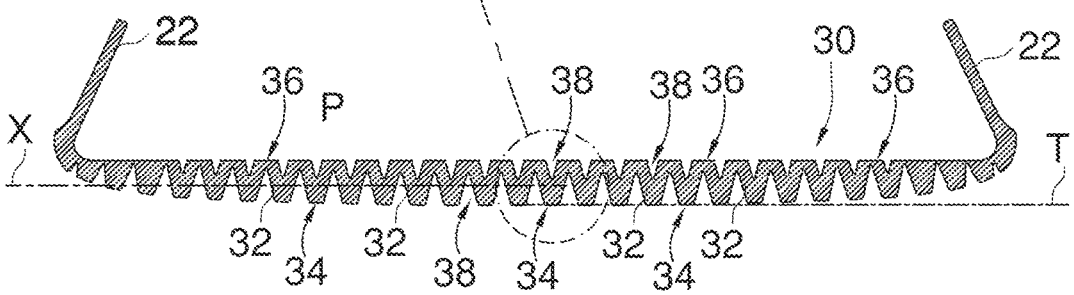
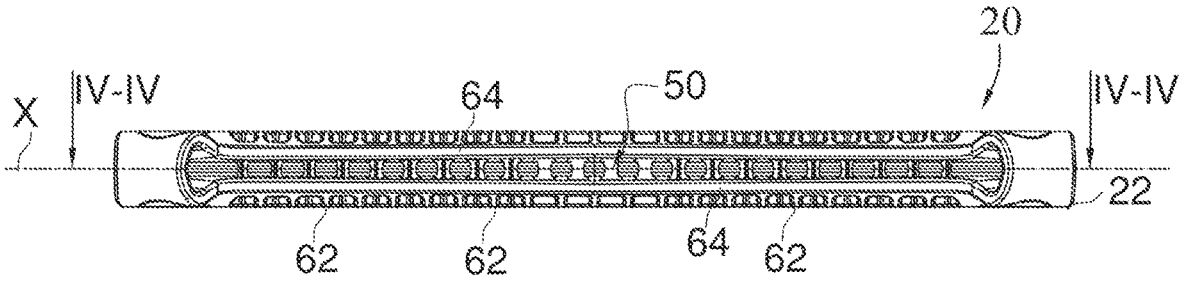
Fig. 3
Fig. 6 Fig. 7
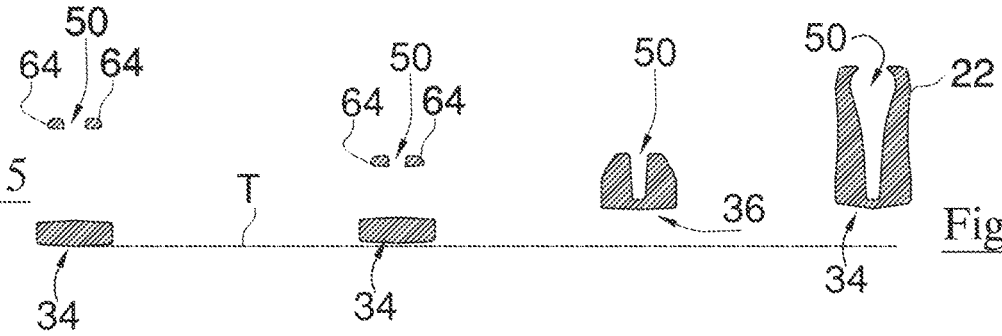
Fig. 5
Fig. 8

BLADE GUARD

FIELD OF THE INVENTION

The invention refers to a blade guard for ice skates.

BACKGROUND OF THE INVENTION

Blade guards for ice skates, used to protect the two sharp edges of a skate blade, comprise an elongated protective element, usually flexible, with a groove inside it, in which the sharp edges of the blade are inserted.

To cover several blade sizes, a well-known blade guard consists of two generally equal, or very similar, pieces which are cut to size and then assembled together through two screwed springs. It is a little comfortable operation which requires special equipment and manpower. In addition, the springs, if not properly treated, can rust thereby compromising the quality of the blade, and during use they could cause minor injuries to the hands. In the market there are different types of blades with different connections that require different housings in the blade guards. Currently the housing is standard and does not guarantee stability and a firm hold for some types of blades, although very popular in the market. Some models (see e.g. U.S. Pat. No. 5,513,881 or U.S. D619185) are designed to solve the problem of housing more types of blades.

Since the blade guards constitute a case for the blade, there is also the problem of its rusting. The stagnant water between the blade and the blade guard promotes the degradation of the blade and imposes the discomfort to dry both carefully and perfectly.

Improving this state of the art is the main object of the invention, which is defined in the attached claims, in which the dependent ones define advantageous variants.

SUMMARY OF THE INVENTION

A blade guard is proposed to protect the edges of an ice skate blade, consisting of or comprising a monolithic element elongated along a longitudinal axis and provided with a longitudinal groove to receive the edges, wherein the groove is formed in a bellows-like structure that is deformable, preferably elastically deformable, along the axis to vary the overall length of the element and the groove.

With the above-mentioned blade guard one has the advantage of getting rid of the above-mentioned springs to adapt the blade guard to different blade sizes and simplifying the structure of the blade guard.

It also follows that an advantage of the blade guard for ice skates is that it is easy to use.

Other advantages of the blade guard are that it is adjustable for blades of various lengths, in particular without the need of equipment and time, is ready for use to the end user;

allows the housing of different types of blades and maintains the stability thereof during movement;

is light to carry and/or aesthetically pleasing.

Said axis is horizontal in use, i.e. when the blade guard is applied to the skate blade and the user is wearing the skate while standing.

Preferably, in order to simplify the structure of the blade guard, the bellows-like structure is a surface of the monolithic element shaped with folds and/or corrugations.

Even more preferably, the material that constitutes the monolithic element is shaped to obtain the bellows-like structure. In particular, the monolithic element is made in such a way that a cross-section of the monolithic element, taken according to a vertical cross-sectional plane (i.e. a plane that is parallel to the longitudinal axis and divides the groove in half) comprises said bellows-like structure. In particular, said cross-section consists of a sequence of linear segments arranged in a bellows-like arrangement and two by two joined to each other at their ends.

For ease of production, e.g. by molding, the bellows-like structure is preferably formed by a plurality of portions being inclined or orthogonal with respect to the longitudinal axis and lined up along the longitudinal axis, which axis also results to be the expansion direction of the bellows-like structure when it is deformed to be fitted to a blade. E.g. each inclined portion of the plurality has two ends in correspondence of which it is joined—respectively—to two other inclined portions of the plurality (this does not hold for the first and last inclined portion of the plurality). That is to say, the inclined portions are two by two joined together to one another at one end thereof, so as to form a zig-zag or serpentine structure. The joining points of the portions at said ends are e.g. curved or angled junctions.

By geometry, the above-mentioned joining points are conceptually distinguishable in two offset and side-by-side rows. For brevity this row is defined first row, the second row being the innermost one in the monolithic element, i.e. the one closest to the groove and/or the blade when present.

Preferably, the bellows-like structure is only one and extends for basically the entire length of the monolithic element, even though different variants are possible: e.g. the bellows-like structure may extend for a fraction of the length of the monolithic element, or the monolithic element incorporates two or more separate bellows-like structures.

Preferably, in order to maximize the maximum expansion, the bellows-like structure extends along substantially the entire length of the blade edge to be covered. For this purpose, preferably the groove has two ends each bounded by a wall intersecting the longitudinal axis to form a cavity in the monolithic element for receiving all the edges.

Preferably the inclined portions are arranged in such a way that they all intersect an axis parallel to said longitudinal axis. Such parallel axis and said longitudinal axis may or may not coincide. This arrangement maximizes the maximum possible expansion for the bellows-like structure.

Preferably the bellows-like structure or the plurality of inclined portions is/are arranged at a base of the monolithic element, the part which in use is placed between the ground and the edge of the blade. Advantageously then the bellows-like structure can also form a sort of "sole" for the blade guard, reinforcing it just where the weight of the athlete acting on the blade could damage it the most. In particular such structure or plurality constitutes a side of the monolithic element, e.g. a side formed by joining points of the inclined portions. Thus one of the two rows of joining points belonging to said plurality forms on a side of the monolithic element a corrugated surface through which, in use, the blade guard rests on the ground.

Preferably the groove comprises a, e.g. flat, bottom which extends tangentially to the bellows-like structure or the second row of joining points. In a variant, the bottom of the groove lies on a line between the first and the second row, i.e. at the second row of joining points each inclined portion comprises a recess for accommodating the edges of the blade. In a different variant the bottom of the groove lies on a line external to the first and second row. In other words, in a variant, the groove can be obtained in the bellows-like structure.

To improve the disposal of stagnant water on the blade, preferably the bellows-like structure and/or the plurality of inclined portions comprises one or more openings that put the groove into communication with the outside of the blade guard (so that the groove can communicate with the outside of the blade guard). In particular, the openings extend from the groove towards the outside of the blade guard along a direction orthogonal to said longitudinal axis. Even more particularly, when the bellows-like structure or the plurality of inclined portions form a serpentine or a zigzag structure, said openings are obtained in one or more of the dihedral angles formed by such portions.

Another advantage of the blade guard then is that it avoids or mitigates the blade rusting problem.

Preferably, to give maximum stiffness against the weight of the athlete, said inclined portions are substantially flat and/or linear.

Preferably the monolithic element comprises two parallel and spaced apart flaps that extend from the bellows-like structure or from the second row of joining points to constitute side walls of the groove.

Even more preferably one or each flap is formed by a lattice made up of, e.g. linear and/or parallel to each other, segments which extend between the bellows-like structure, or the joining points of the second row, and a common connecting element that flanks the bellows-like structure or the inclined portions in parallel with the longitudinal axis and constitutes a margin of the groove. Thus pass-through openings, useful to dispose of stagnant water on the blade, are created by construction in the monolithic element between the various segments, the common connection element and the second row of joining points or the bellows-like structure.

Preferably, the blade guard has a mirror-like structure with respect to a plane passing through its center and orthogonal to said longitudinal axis.

The monolithic element is preferably made of parts joined together and not detachable; or not relatively movable. More preferably, the monolithic element is in one-piece and/or mono-material, e.g. a moulded piece by moulding plastic or rubber material.

Preferably the length of the inclined portions (i.e. the distance between the two ends at which each portion joins another one) is not constant along the bellows-like structure, but is greater in the center of the monolithic element and smaller and smaller upon moving away from the center.

To better follow the edges of the blade, preferably the bellows-like structure develops along an arc.

The portions of the blade guard forming the sides of the groove may be enlarged or sized so as to strengthen this part and prevent the tip and tail of the blade from cutting the blade guard.

Preferably inside the groove there are embossed notches or lines or elements, e.g. protruding from the surface of the portions or flaps of the blade guard forming the sides of the groove. This prevents the blade from coming out of the groove accidentally. Preferably the surface of the bottom of the longitudinal groove comprises an embossed convexity that extends at the center of the groove along the longitudinal axis of the groove.

This convexity solves the problem of protecting the blade edges from deformation, and might be integrated autonomously with the same advantages into a, e.g. conventional, blade guard or in a blade guard for protecting the edges of an ice skate blade, the blade guard consisting of or comprising an element elongated along a longitudinal axis and provided with a longitudinal groove for receiving the edges. The blade guard provided with the above-mentioned convexity can share one or each variant described here.

To better evacuate stagnant water from the groove, preferably the bottom of the longitudinal groove comprises pass-through openings that cross the thickness of the blade guard. In particular, said pass-through openings have an entry on the surface of the groove's bottom, and an exit on the side of the blade guard that in use touches the ground.

BRIEF DESCRIPTION OF THE DRAWINGS

The advantages of the invention will be made even clearer by the following description of a preferred example of a blade guard, with reference to the attached drawing in which

FIG. 3 shows a top view of the blade guard;

FIG. 4 shows a cross-sectional view according to plane IV-IV;

FIG. 5 shows a cross-sectional view according to plane V-V;

FIG. 6 shows a cross-sectional view according to plane VI-VI;

FIG. 7 shows a cross-sectional view according to plane VII-VII;

FIG. 8 shows a cross-sectional view according to plane VIII-VIII;

In the figures equal numbers indicate equal or conceptually similar parts, and the elements are described as in use. In order not to crowd the figures some numerical references are omitted.

DETAILED DESCRIPTION OF A PREFERRED EMBODIMENT

Figure 1:
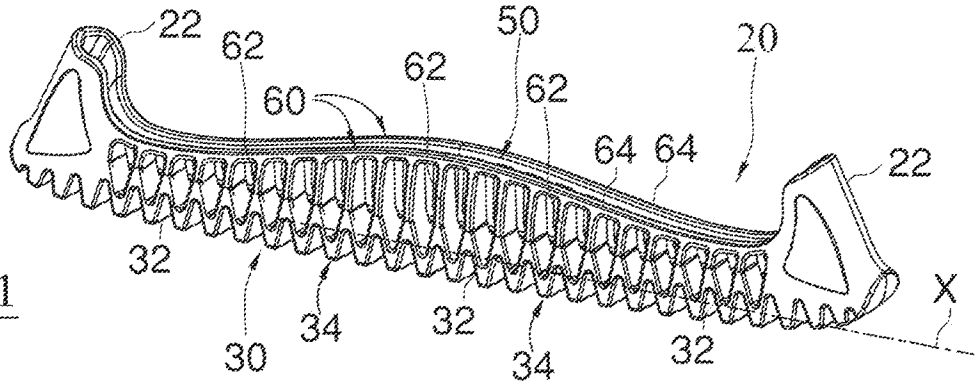
FIG. 1 shows a three-dimensional view of a blade guard.
Figure 2:
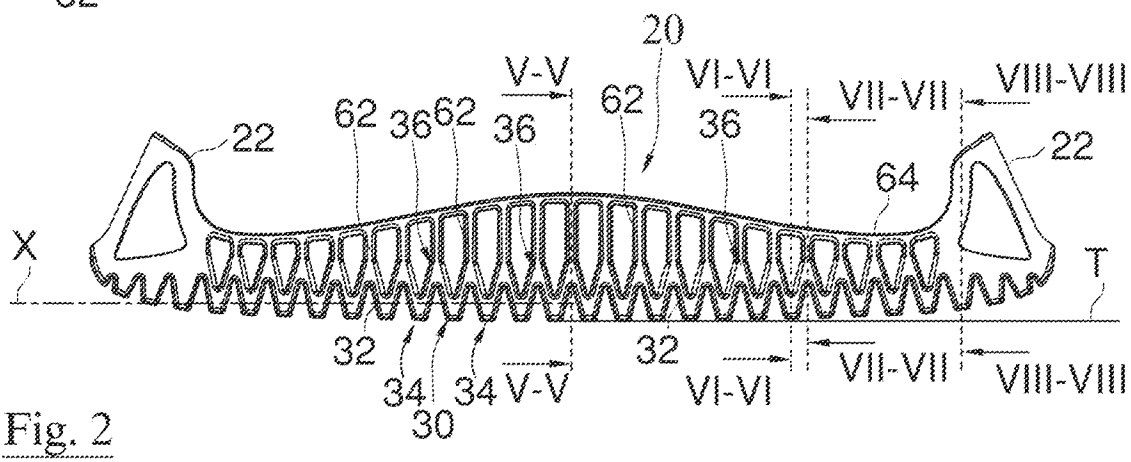
FIG. 2 shows a side view of the blade guard.

The blade guard consists of a one-piece element 20 which is elongated along a longitudinal axis X and provided with a longitudinal groove 50 for receiving the blade edges (the blade of an ice skate has two sharp, parallels edges). The groove 50 is delimited at its ends by two raised caps 22, adapted to embrace the ends of the blade (not shown) guaranteeing grip.

The groove 50 is made in a bellows-like structure 30 that in use forms a rest base on a ground T for the blade. The structure 30 is deformable along the X axis to vary the overall length of the blade guard and the groove 50.

The material making up the element 20, in the example plastic or rubber, is shaped with a corrugation to create the bellows-like structure 30.

In the example shown the corrugation is formed by a plurality of portions 32 inclined with respect to the X axis and lined up along the X axis. Each portion 32 has ends joined to two other portions 32, so as to form a zigzag serpentine. In the zigzag serpentine a portion 32 and the next one define a dihedral angle P.

Since the bellows-like structure 30 extends for substantially the whole length of the base of the element 20, it can easily lengthen, better if elastically, along X both to facilitate the mounting of the blade guard on the blade, and to stretch and fit to larger blades.

Note the advantage of this simple and easy-to-produce construction opposed to multi-component blade guards with additional elastic elements.

The joining points of the portions 32 are conceptually distinguishable in two offset and side-by-side rows: a row of points 34 on the outside of the element 20 and an inner row of points 36.

Therefore the points 34 form a "sole" for the blade when the blade guard is applied on it. In other words, the element 20 rests on the ground T by means of the surfaces of the aligned points 34, with the advantage of distributing the weight of the skater on different points and, above all, following the skater in his movements of the walk.

On the other hand, the points 36 form a "support bed" for the edges of the blade, with the advantage of distributing the weight thereof over many effective bearing points in the blade guard. Another advantage is that the residual water on the blade does not stagnate around the edge but falls by gravity into the empty spaces 38 which naturally form around the raised points 36 thanks to the convergence towards the groove 50 of the portions 32. Water fallen into the empty spaces 38 comes out then from the element 20. Note that for this purpose the sequence of portions 32, which forms a zigzag structure extending along the X axis, preferably is open towards the sides of the monolithic element 20 (see cross-section in FIG. 4). The zigzag structure formed by the portions 32 comprises pass-through openings in the element 20 that pass through it from one side to the other, thus favoring the disposal of stagnant water on the blade. In particular the angles P are gaps to form the pass-through openings. Preferably the length of the inclined portions 32 (see FIG. 4) is not constant along the bellows-like structure 30, but is greater at the center of the element 20 and smaller as it is away from the center. In this way the bellows-like structure 30 stretches more at the center thereof and not at its extremes, where it could weaken the grip of the caps 22.

The element 20 comprises two optional, parallel to each other and spaced apart flaps 60 that extend from the second row of points 36 forming side walls of the groove 50. Each flap 60 is formed by a lattice consisting of parallel linear segments 62 which extend between the bellows-like structure 30 and a common connecting cord 64 joining the two caps 22. Pass-through openings in the element 20, useful to dispose of stagnant water on the blade and help it dry, remain defined between the segments 62, the cord 64 and the row of points 36.

The function and advantage of the flaps 60 is mainly to ensure sealing and lateral stability for several types of blades.

One or each flap 60 may also be without the pass-through openings.

Figure 9:
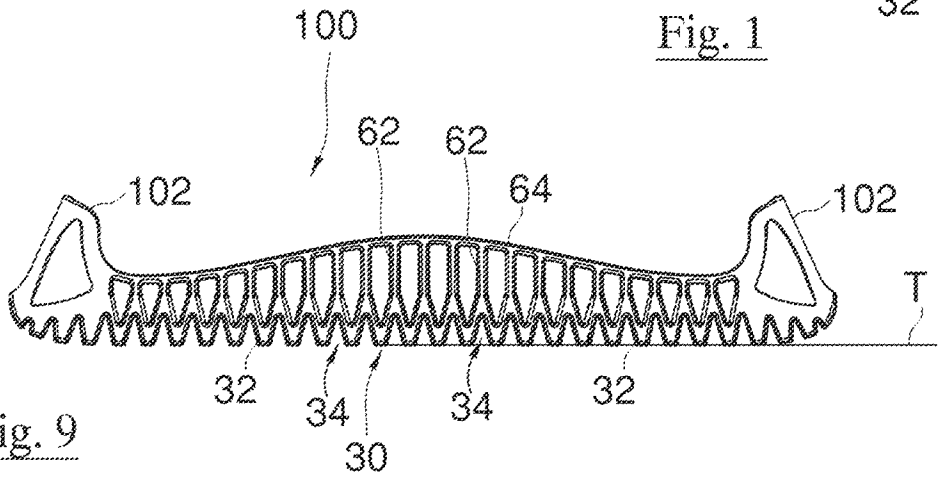
FIG. 9 shows a side view of a variant of blade guard.

A variant of blade guard 100 is shown in FIG. 9.

The blade guard 100 differs from the previous one for the shape in correspondence of the raised caps 102, which are more flattened toward the ground T compared to the caps 22. In other words, while the blade guard 20 has an overall curved shape, in which the part of the bellows-like structure 30 belonging to the caps 22 is raised with respect to ground T, the blade guard 100 has an overall flat or flatter shape, in which the part of the bellows-like structure 30 belonging to caps 102 is essentially adherent—in use—to the ground T.

Figure 10:
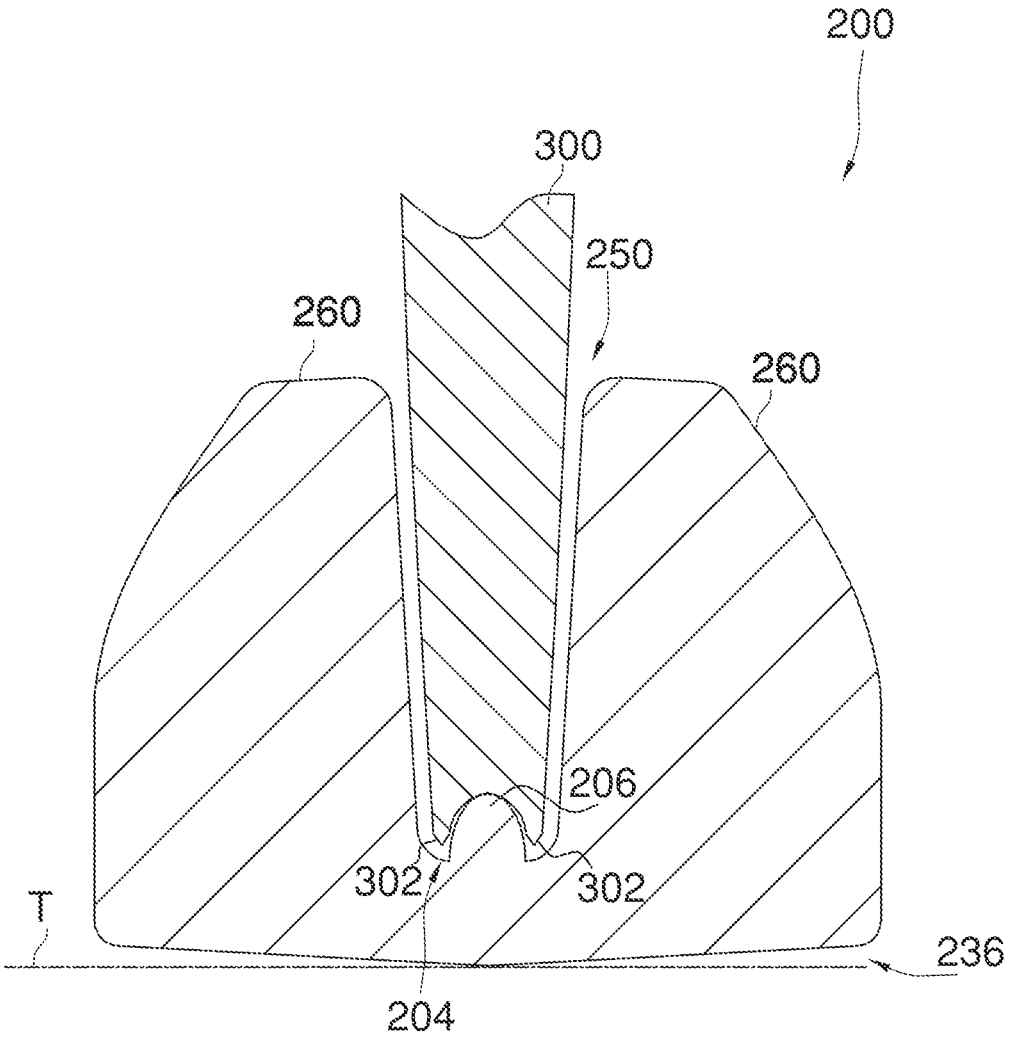
FIG. 10 shows a cross-sectional view according to plane VII-VII for a variant of blade guard.

Another variant of blade guard 200 is shown in FIG. 10, which shows a cross-sectional view equivalent to plane VII-VII.

The blade guard 200 still comprises a one-piece element provided with a longitudinal groove 250 for a blade 300, whose two parallel cutting edges 302 separated by a recess are now apparent. The groove 250 is—as before—delimited by side walls or flaps 260.

The variant consists in that the bottom 204 of the groove 250 is not flat but comprises a convexity 206 that extends at the center of the above-mentioned bottom along the longitudinal X axis of the groove 250. The convexity 206 is achievable by means of e.g. one or more aligned reliefs that extend centrally on the bottom of the groove 250 along the longitudinal X axis. In the case of a single relief, it is carried out e.g. as an edge protruding from the bottom 204. The convexity 206, or a or each relief, has a cross-section preferably substantially complementary to the recess between the edges 302 and a height equal to or greater than the depth of such recess. In this way when the blade 300 is inserted into the groove 250, the edges 302 do not rest (or rest little) on the bottom 204. The blade 300 rests completely or mainly on the element 206, with the advantage that the sharpening of the edges 302 is not altered.

The convexity 206 described here is optional, and not limited to the variant of FIG. 10. In fact the convexity 206 may be applied, alternatively or in combination, to all the blade guards of the previous figures and/or to a or each of the cross-sections in FIGS. 5/8. The convexity 206 described here may also be integrated into a conventional blade guard.

As an option for each described variant, the bottom of the groove that receives the blade may have pass-through openings that pass through the thickness of the blade guard perpendicularly to the direction of the blade's insertion (along a plane passing through the X axis and dividing the groove in half). The advantage is evacuating the water stagnating in the groove more.

The invention claimed is:

1. Blade guard for protecting the edges of an ice-skate blade, consisting of or comprising a monolithic element elongated along a longitudinal axis and provided with a longitudinal groove for receiving the edges, wherein the groove is formed in a bellows-like structure that is deformable along the longitudinal axis to vary the overall length of the element and of the groove, the bellows-like structure being formed by a plurality of portions inclined or orthogonal to the longitudinal axis and placed in a row along the longitudinal axis, the inclined portions being two by two joined together at one of their ends, so as to form a zigzag or serpentine structure, with empty spaces formed on opposite sides of the bellows-like structure between any of two adjacent said inclined portions, the bottoms of the empty spaces on one of said opposite sides extending, when seen in cross-section, past the bottoms of the empty spaces on the other of said opposite sides.

2. Guard according to claim 1, wherein the bellows-like structure is a surface of the monolithic element shaped with folds and/or corrugations.

3. Guard according to claim 1, wherein the material constituting the monolithic element is shaped to form the bellows-like structure.

4. Guard according to claim 1, wherein the bellows-like structure is only one and extends for substantially the whole length of the monolithic element.

5. Guard according to claim 1, wherein the inclined portions are arranged so as to all intersect an axis parallel to said longitudinal axis.

6. Guard according to claim 1, wherein the bellows-like structure or the plurality of inclined portions is/are arranged at a base of the monolithic element, the part which in use is arranged between the ground and the edges of the blade.

7. Guard according to claim 1, wherein the bellows-like structure or the plurality of inclined portions comprises one or more openings which put the groove into communication with the outside of the blade guard.

8. Guard according to claim 7, wherein the inclined portions are arranged so as to form a zigzag structure in which two inclined portions form a dihedral angle, said dihedral angle being empty to form one or more of said openings.

9. Guard according to claim 1, wherein the surface of the bottom of the longitudinal groove comprises an embossed convexity extending at the center of the groove along the longitudinal axis of the groove.

10. Guard according to claim 1, wherein the bottom of the longitudinal groove comprises pass-through openings crossing the thickness of the blade guard.

11. Guard according to claim 1, wherein said portions at said ends have joining points which are curved or angled junctions.

12. Guard according to claim 11, wherein the joining points form two offset and side-by-side rows, a first row and a second row being the innermost one in the monolithic element and closest to the groove, the groove having a bottom which lies on a line between the first and second row.

13. Guard according to claim 11, wherein the joining points form two offset and side-by-side rows, a first row and a second row being the innermost one in the monolithic element and closest to the groove, wherein the bottom of the groove lies on a line external to the first and second row.

14. Guard according to claim 1, wherein the groove has two ends each bounded by a wall intersecting the longitudinal axis to form a cavity in the monolithic element for receiving all the edges of the ice-skate blade.

15. Guard according to claim 1, wherein said structure or plurality constitutes a side of the monolithic element formed by joining points of the inclined portions, so that a row of joining points belonging to said plurality forms on a side of the monolithic element a corrugated surface through which, in use, the blade guard rests on the ground.

16. Guard according to claim 1, wherein the length of the inclined portions, i.e. a distance between two ends at which each portion joins another one, is not constant along the bellows-like structure, but is greater in the center of the monolithic element and smaller and smaller upon moving away from the center.

17. Guard according to claim 1, wherein said inclined portions are substantially linear.

18. Guard according to claim 1, wherein the monolithic element comprises two parallel and spaced apart flaps that extend from the bellows-like structure to constitute side walls of the groove.

19. Guard according to claim 1, wherein the monolithic element comprises two parallel and spaced apart flaps that extend from the bellows-like structure to constitute side walls of the groove, one or each flap being formed by a lattice made up of segments which extend between the bellows-like structure and a common connecting element that flanks the bellows-like structure in parallel with the longitudinal axis and constitutes a margin of the groove.

20. Guard according to claim 1, wherein the longitudinal groove has a bottom with a surface comprising an embossed convexity that extends at the center of the groove along the longitudinal axis of the groove.

* * * * *